US007490441B2

(12) United States Patent
Burton et al.

(10) Patent No.: US 7,490,441 B2
(45) Date of Patent: Feb. 17, 2009

(54) HIGH PERFORMANCE WINDOW AND DOOR INSTALLATION

(75) Inventors: Cordell R. Burton, Pella, IA (US); Scot C. Miller, Pella, IA (US); Gabriel P. Gromotka, Pella, IA (US)

(73) Assignee: Pella Corporation, Pella, IA (US)

( * ) Notice: Subject to any disclaimer, the term of this patent is extended or adjusted under 35 U.S.C. 154(b) by 381 days.

(21) Appl. No.: 11/340,253

(22) Filed: Jan. 26, 2006

(65) Prior Publication Data

US 2007/0094957 A1 May 3, 2007

Related U.S. Application Data

(60) Provisional application No. 60/726,573, filed on Oct. 14, 2005.

(51) Int. Cl.
*E06B 7/14* (2006.01)

(52) U.S. Cl. ..... 52/209; 52/302.1

(58) Field of Classification Search ..... 52/209, 52/204.1, 302.7, 97, 711, 707, 708, 223.13, 52/231, 156; 49/408; 137/142
See application file for complete search history.

(56) References Cited

U.S. PATENT DOCUMENTS

| | | | | | |
|---|---|---|---|---|---|
| 304,183 | A | * | 8/1884 | Davis | 52/97 |
| 396,327 | A | * | 1/1889 | Crane | 52/97 |
| 1,668,564 | A | * | 5/1928 | Jenkins | 52/97 |
| 1,836,980 | A | * | 12/1931 | Marty | 52/771 |
| 1,881,778 | A | * | 10/1932 | Madsen | 52/97 |
| 2,305,252 | A | * | 12/1942 | Hayden | 52/701 |
| 2,700,441 | A | | 1/1955 | Cudini | |
| 2,879,660 | A | * | 3/1959 | Reintjes | 52/509 |
| 2,952,947 | A | * | 9/1960 | White | 52/708 |
| 3,192,670 | A | * | 7/1965 | Jones, III | 52/95 |
| 3,250,049 | A | | 5/1966 | Skiar | |
| 3,585,770 | A | | 6/1971 | Maizler | |
| 3,599,379 | A | * | 8/1971 | Tuska | 52/707 |
| 3,690,079 | A | | 9/1972 | Hemminger | |
| 3,692,040 | A | * | 9/1972 | Kundert | 137/142 |
| 3,782,064 | A | | 1/1974 | Hubbard et al. | |
| 3,851,420 | A | | 12/1974 | Tibbetts | |

(Continued)

OTHER PUBLICATIONS

Installation Instructions for New Construction Vinyl Window with Integral Nailing Fin, JELD-WEN Windows & Doors, © 2003, 6 pages.

(Continued)

*Primary Examiner*—Robert J Canfield
*Assistant Examiner*—Brent W Herring
(74) *Attorney, Agent, or Firm*—Faegre & Benson LLP

(57) ABSTRACT

A drainage system for a fenestration assembly is located in a rough opening of a structure. The drainage system includes a moisture barrier located between at least a bottom of the fenestration assembly and a bottom inner surface of the rough opening. The moisture barrier includes a vertical portion extending generally vertically downward below the rough opening on an external side of the structure. A channel assembly is located generally below the rough opening. The channel assembly includes at least one channel having a channel entrance proximate the bottom inner surface of the rough opening and a discharge opening direct toward a drainage area. The channel includes an effective cross-sectional area adapted to siphon water located on the moisture barrier to the drainage area.

39 Claims, 7 Drawing Sheets

U.S. PATENT DOCUMENTS 3,889,423 A 6/1975 Begin
3,919,815 A * 11/1975 Alabaster ..... 52/97
4,001,972 A 1/1977 Hurwitz
4,055,923 A 11/1977 Biebuyck
4,080,763 A * 3/1978 Naidus et al. ..... 52/200
4,141,190 A * 2/1979 Shimada ..... 52/711
4,387,542 A 6/1983 Wehr
4,406,300 A * 9/1983 Wilson ..... 137/132
4,555,882 A 12/1985 Moffitt et al.
4,621,478 A 11/1986 Phillips et al.
4,627,206 A * 12/1986 Cox ..... 52/209
4,637,183 A 1/1987 Metz
4,644,717 A 2/1987 Biebuyck
4,672,784 A 6/1987 Pohlar
4,691,487 A 9/1987 Kessler
4,713,922 A 12/1987 Ingold
4,715,152 A 12/1987 Tanikawa
4,731,952 A 3/1988 Mascotte
4,731,965 A 3/1988 Jensen
4,852,312 A 8/1989 Harbom
4,887,407 A 12/1989 Nelson
5,026,581 A 6/1991 Shea, Jr. et al.
5,042,199 A 8/1991 Schneider et al.
5,054,250 A 10/1991 Foss
5,179,969 A * 1/1993 Peterson ..... 137/1
5,299,399 A * 4/1994 Baier et al. ..... 52/204.52
5,319,884 A * 6/1994 Bergeron ..... 49/504
5,327,684 A 7/1994 Herbst
5,394,657 A * 3/1995 Peterson ..... 52/12
5,423,149 A 6/1995 Herbst
5,524,391 A 6/1996 Joffe et al.
5,542,217 A 8/1996 Larivee, Jr.
5,655,343 A 8/1997 Seals
5,675,870 A 10/1997 Cooper
5,692,350 A 12/1997 Murphy, Jr.
5,701,780 A 12/1997 Ver Meer
5,822,933 A 10/1998 Burroughs et al.
5,839,236 A 11/1998 Frey
5,857,299 A 1/1999 Gyllenberg et al.
5,890,331 A 4/1999 Hope
5,921,038 A * 7/1999 Burroughs et al. ..... 52/209
5,934,828 A * 8/1999 Hu et al. ..... 405/43
5,937,597 A 8/1999 Sono et al.
6,014,846 A 1/2000 Sono et al.
6,018,916 A 2/2000 Henry
6,098,343 A 8/2000 Brown et al.
6,170,198 B1 1/2001 Staples et al.
6,185,792 B1 2/2001 Nelson et al.
6,223,484 B1 5/2001 Minter
6,276,099 B1 * 8/2001 O'Shea ..... 52/204.1
6,374,557 B1 * 4/2002 O'Donnell ..... 52/209
6,381,911 B1 5/2002 Weiland
6,385,925 B1 * 5/2002 Wark ..... 52/209
6,405,501 B1 6/2002 Cerrato
6,408,922 B2 6/2002 Desrochers
6,722,089 B2 4/2004 Budzinski
7,237,365 B1 * 7/2007 Phandanouvong ..... 52/209
7,367,164 B2 * 5/2008 Burton et al. ..... 52/209
2002/0157328 A1 10/2002 Holder
2003/0177699 A1 * 9/2003 Fukuro et al. ..... 49/408
2003/0177727 A1 * 9/2003 Gatherum ..... 52/302.6
2005/0097837 A1 * 5/2005 Burton ..... 52/204.1
2005/0138875 A1 6/2005 Grunewald et al.
2005/0144865 A1 * 7/2005 Ellingson ..... 52/272
2005/0188625 A1 9/2005 Cantrell
2005/0193654 A1 9/2005 Primozich
2005/0235571 A1 10/2005 Ewing et al.
2005/0262771 A1 12/2005 Gorman
2005/0262782 A1 12/2005 Harrison et al.
2006/0236618 A1 * 10/2006 Williams ..... 52/58

OTHER PUBLICATIONS

Jamsill, Inc.; Jamsill Guard™, 5 pages, © 2005, http://www.jamsill.com/Products.php.
Installation Instruction: HurricaneShield™ / Advanced Performance Casement and Awning Windows, 4 pages, © Pella Corporation, 2001.
Clad Casement & Awning Window Installation Instructions, 5 pages, © Pella Corporation, 2004.
Clad Double-Hung Window Installation Instructions, 5 pages, © Pella Corporation, 2004.
Wood Window Installation, New Wood Frame Construction, Marvin Windows and Doors, Dec. 12, 2006, 13 pages.

* cited by examiner

HIGH PERFORMANCE WINDOW AND DOOR INSTALLATION

RELATED APPLICATIONS

The present application claims the benefit of U.S. Provisional Patent Application Ser. No. 60/726,573, entitled High Performance Window and Door Installation, filed Oct. 14, 2005, the disclosure of which is hereby incorporated by reference.

TECHNICAL FIELD

The present invention relates to a high performance fenestration assembly installation system, and in particular, to a drainage system with a siphoning action that expels moisture.

BACKGROUND OF THE INVENTION

Fenestration assemblies are typically installed in rough openings in structures. A gap is typically maintained between the fenestration assembly and the rough opening to accommodate expansion and contraction of building materials throughout temperature changes, as well as overall shifting and settling of the structure. Water, such as airborne moisture and liquid water in the form of rainwater, ice, snow can penetrate into the building wall interior from in and around building fenestration assemblies.

Attempts have been made to prevent entry of water into the building wall interior by sealing or caulking entry points in and around fenestration assemblies as the primary defense against water intrusion, or by installing flashing around the fenestration assemblies to divert the water. These attempts have not been completely successful. Sealants are not only difficult and costly to properly install, but tend to separate from the fenestration assembly or wall due to climatic conditions, building movement, the surface type, or chemical reactions. Flashing is also difficult to install and may tend to hold the water against the fenestration assembly, accelerating the decay.

The efficiency of such weatherproofing relies largely on the careful installation of both the fenestration assembly and the weatherproofing materials. However, no matter how carefully installed, moisture may enter into gaps between the fenestration assembly and the rough opening. Moisture penetration may be due to shifting or expansion/contraction of materials post-installation.

Such moisture typically collects below the fenestration assembly, where it can cause rot and other undesirable damage to both the fenestration assembly and the structure below the fenestration assembly. In some situations attempts to prevent water penetration around fenestration assemblies may actually trap the water within the structure, exacerbating the problem.

Various drain holes systems for fenestration assemblies have been used to divert water from the structure, such as disclosed in U.S. Pat. Nos. 3,851,420 (Tibbetts); U.S. Pat. No. 4,691,487 (Kessler); and U.S. Pat. No. 5,890,331 (Hope).

Specialized flashing structures have been developed for installation in the gap between the rough opening and the fenestration assembly. Examples of such specialized flashing structures are shown in U.S. Pats. No. 4,555,882 (Moffitt et al.); U.S. Pat. No. 5,542,217 (Larivee); and U.S. Pat. No. 6,098,343 (Brown et al.). U.S. Pat. No. 5,822,933 (Burroughs et al.) and U.S. Pat. No. 5,921,038 (Burroughs et al.) disclose a water drainage system with an angled pan and a plurality of ribs that is located underneath a fenestration assembly.

These specialized flashing structures, however, do not effectively remove water from the interior of the structure. Additionally, the installation of moisture guards often requires changes in the way the fenestration assembly is installed into the rough opening and how the fenestration assembly is finished on the room side so as to accommodate the vertical height of the angled pan. Furthermore, the gap between the fenestration assembly and the rough opening must be sufficient to accommodate the raised end of the angled pan.

The Installation Instructions for New Construction Vinyl Window with Integral Nailing Fin published by Jeld-Wen, Inc. discloses installing a 6" tall section of screen to the exterior of the structure below the fenestration assembly. The screen extends about the width of the fenestration assembly and is located on top of flashing tape and building wrap. Another layer of flashing tape is applied to the top of the screen. The screen, however, forms one contiguous channel that is too large to permit effective drainage of water.

BRIEF SUMMARY OF THE INVENTION

The present invention is directed to a drainage system for a fenestration assembly located in a rough opening of a structure. The drainage system includes a moisture barrier located between at least a bottom of the fenestration assembly and a bottom inner surface of the rough opening. The moisture barrier includes a vertical portion extending generally vertically downward below the rough opening on an external side of the structure. A channel assembly is located generally below the rough opening. The channel assembly includes at least one channel having a channel entrance proximate the bottom inner surface of the rough opening and a discharge opening direct toward a drainage area. The channel includes an effective cross-sectional area adapted to siphon water located on the moisture barrier to the drainage area.

The channel assembly may be a block of material with a plurality of channels, a plurality of ribs forming a plurality of discrete channels, a carrier having a plurality of ribs forming a plurality of open channels, or a woven or non-woven web of material and a flashing tape sealing a front and at least a portion of side edges of the web of material to the vertical portion of the moisture barrier.

In one embodiment, the channel assembly is located less than four inches from bottom corners of the rough opening, or more preferably be located less than two inches from bottom corners of the rough opening.

The channel preferably has an effective cross-sectional area in the range of about 0.0012 $inch^2$ to about 0.625 $inch^2$, and more preferably about 0.0012 $inch^2$ to about 0.1 $inch^2$ and most preferably about 0.0012 $inch^2$ to about 0.05 $inch^2$. Channels with generally circular cross-sectional areas preferably have a diameter of about 0.040 inches to about 0.4 inches. Channels with non-circular cross-sectional area preferably have a major dimension of about 0.04 inches to about 6 inches and a minor dimension of about 0.040 inches to about 0.4 inches.

The drainage system is installed with a fenestration assembly located in a rough opening of a structure by first locating a moisture barrier between at least a bottom of the fenestration assembly and a bottom inner surface of the rough opening. Then, the moisture barrier is extended generally vertically downward below the rough opening on an external side of the structure to form a vertical portion. A channel assembly is located generally below the rough opening so that a channel entrance is proximate the bottom inner surface of the rough opening and a discharge opening is directed toward a drainage area. Finally, a channel is selected with an effective cross-sectional area adapted to siphon water located on the moisture barrier to the drainage area.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

Figure 1:
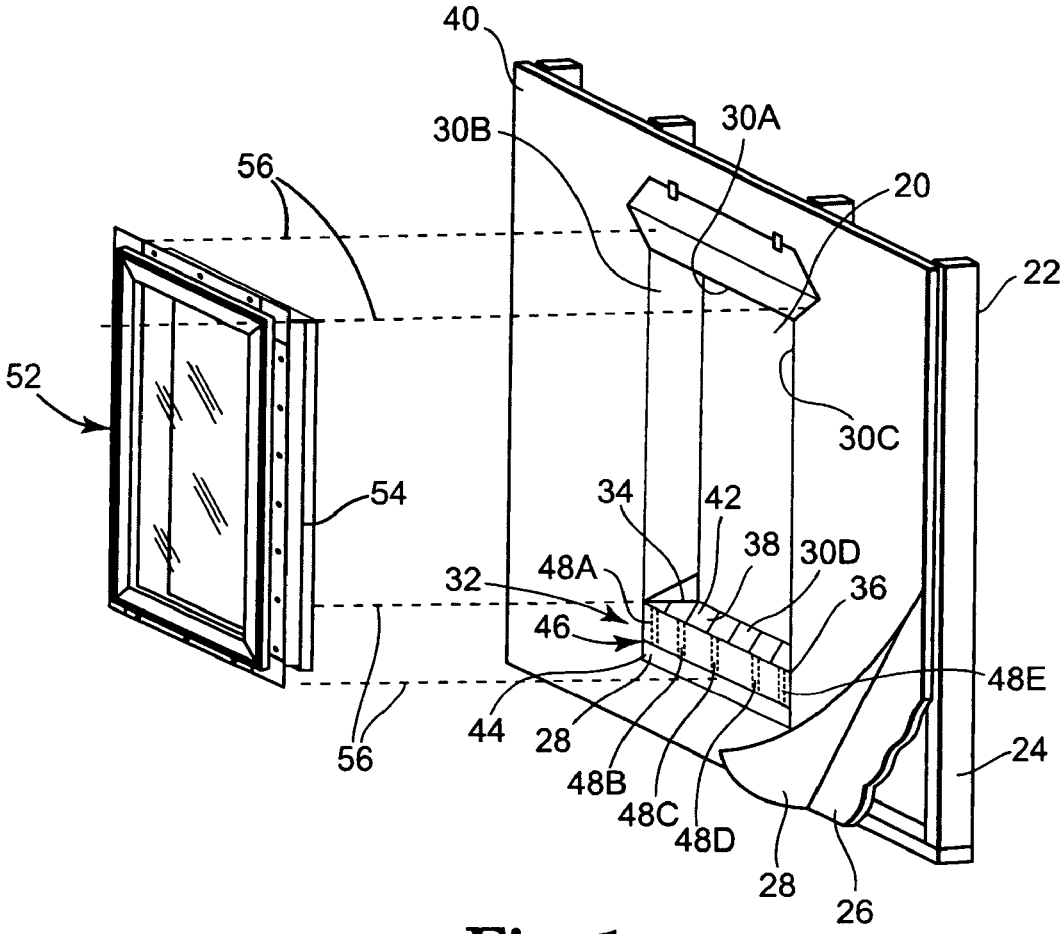
FIG. 1 is an exploded perspective view of a structure and a fenestration assembly with the drainage system in accordance with the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION OF THE INVENTION

Figure 2:
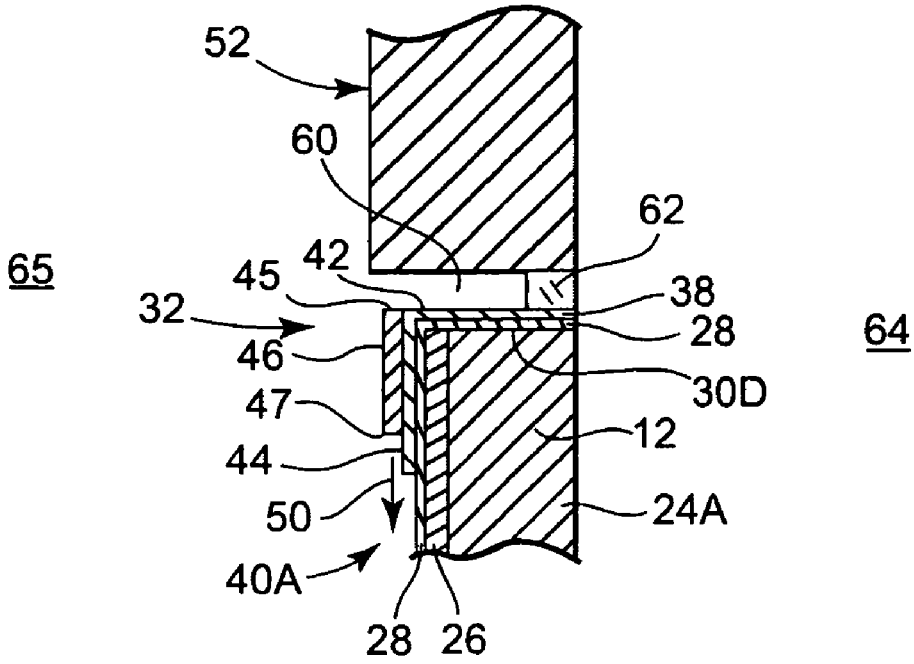
FIG. 2 is a cross sectional view of the drainage system of FIG. 1 with the fenestration assembly installed.
Figure 3:
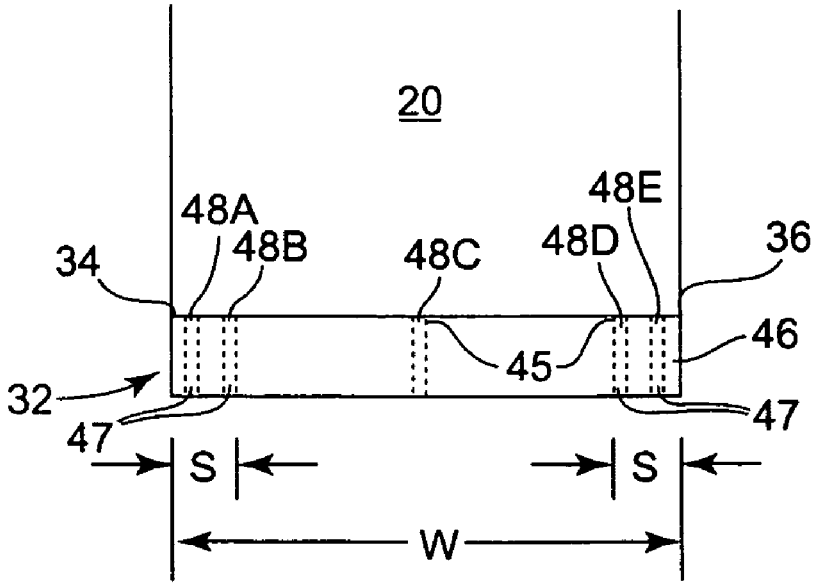
FIG. 3 is a front view of the drainage system of FIG. 1.

FIGS. 1-3 illustrate one embodiment of a drainage system 32 of the present invention. Rough opening 20 is located in a section of a structure 22. In the illustrated embodiment, the structure 22 includes framing members 24, a sheathing layer 26 and a water resistant barrier 28. The water resistant barrier 28 preferably wraps around at least a portion of inner surfaces 30A, 30B, 30C, 30D of the rough opening 20. As best illustrated in FIG. 2, the water resistant barrier 28 preferably wraps onto inner surface 30D of sill plate 24A, which is the framing member 24 located at the bottom of the rough opening 20.

The present drainage system 32 preferably includes moisture barrier 38 located along at least a portion of inner surface 30D and extending downward below the rough opening 20 along exterior surface 40 of the water resistant barrier 28. In some embodiments, the moisture barrier 38 may extend vertically along a portion of the inner surfaces 30B, 30C.

In the illustrated embodiment, the moisture barrier 38 includes a collection surface 42 located above and parallel to the inner surface 30D and a generally vertical surface 44 located generally on the exterior surface 40 immediately below the rough opening 20 and in front of the sill plate 24A. In the preferred embodiment, the moisture barrier 38 is located on top of the water resistant barrier 28. In an alternate embodiment, the moisture barrier 38 can be located directly on the inner surface 30D of the sill plate 24A.

The moisture barrier 38 can be constructed from a variety of flexible, semi-rigid or rigid materials, such as, for example, metal, plastic, or composites thereof. The moisture barrier 38 can, for example, be a flexible sheet material, a thin metal material that can be bent into the desired shape, or a molded article. In one embodiment, the moisture barrier 38 is metal flashing. In another embodiment, the moisture barrier 38 is a foil-backed flashing tape. The moisture barrier 38 can optionally be a pre-formed sill pan. The moisture barrier 38 can be secured in the rough opening 20 using a variety of conventional methods, such as for example nails, screws, clips, brackets, and/or adhesives.

Channel assembly 46 is located on the generally vertical surface 44 of the moisture barrier 38 generally in front of the sill plate 24A. As will be discussed in detail below, the channel assembly 46 includes one or more channels 48A-48E (referred to collectively as "48") that are configured to siphon water on the collection surface 42 from the channel entrance 45 in direction 50 and out a discharge opening 47 to a drainage area 40A. As used herein, "siphon" refers to conduit that uses the weight of a liquid to pull the liquid from the higher level to a lower level.

The channels 48 can be located anywhere along the width W of the rough opening 20. Most water penetration, however, occurs between a fenestration assembly 52 and the vertical inner surfaces 30B, 30C of the rough opening 20. Water tends to concentrate on the collection surface 42 near the bottom corners 34, 36 of the rough opening 20. As used herein, the term "bottom corner" also refers to the intersection of a sill plate and a mullion separating adjacent fenestration assemblies, or the intersection of a sill plate and two vertical surfaces of adjacent fenestration assemblies. In the preferred embodiment, the channels 48 are concentrated near the bottom corners 34, 36. In one embodiment the channels 48A, 48B, 48C, 48D and 48E are located within a distance S from the bottom corners 34, 36. The distance S is preferably less than 4 inches, and more preferably less than 2 inches, and most preferably less than 1 inch.

The fenestration assembly 52 includes a frame 54 that is sized to fit into the rough opening 20. As used herein, "fenestration assembly" refers to double-hung, casement, awning and fixed windows, skylights, sliding and hinged doors, and the like. As indicated by the dashed lines 56, the fenestration assembly 52 is inserted into the rough opening 20 above the drainage system 32.

As best illustrated in FIG. 2, the rough opening 20 is larger than the fenestration assembly 52, creating gap 60 in which water may collect. Interior seal 62 is optionally located near an interior side 64 of the sill plate 24A to prevent water that collects in the gap 60 from migrating toward the interior 64 of the structure 22.

In embodiments where the collection surface 42 is generally horizontal, the interior seal 62 is preferably included. Because the gap 60 is open to an exterior side 65 of the fenestration assembly 52 at least where any leaks are occurring, and likely through the channels 48 as well, the air pressure within the gap 60 will tend to be the same as the air pressure at the exterior side 65 of the fenestration assembly 52. The seal 62 isolates the gap 60 from air pressure on the interior side 64. This feature helps to ensure that the air pressure within the gap 60 is never lower than the air pressure on the exterior side 65, which could cause moisture to flow up the channels 48A-48E and into the gap 60.

The drainage system 32 removes moisture from the gap 60 in the following manner. As moisture leaks into the rough opening 20 from any location around the fenestration assembly 52, the moisture flows downwardly into the gap 60 under the force of gravity and collects on the collection surface 42. The collection surface 42 is water impermeable, so the sill plate 24A is protected from water damage.

Eventually, due to random accumulation and flow of moisture across the collection surface 42, or because the collection surface 42 is completely covered, moisture accumulates over the channel entrances 45. Surface tension in the water molecules will for a time prevent the moisture from flowing down the channels 48A-48E. However, as moisture continues to accumulate, the weight of the water causes the water immediately adjacent the channel entrances 45 to flow down the channels 48 and out the discharge openings 47 into the drainage area 40A. As water flows down the channels 48, a vacuum is created above the draining water, which draws more water down from the channel entrances 45, and so on. The negative or vacuum pressure of the descending water is strong enough to cause water on the collection surface 42 to be pulled towards the channel entrances 45. In this manner, moisture collecting on the collection surface 42 is removed to the drainage area 40A.

Because the channels 48 generate sufficient vacuum pressure to pull moisture from across the collection surface 42 towards the channel entrance 45, it is unnecessary for the collection surface 42 to be tilted or angled toward the channel assembly 46. Thus, a drainage system 32 in accordance with the present invention does not require substantial modifications to the fenestration assembly 52 installation procedures, nor to the fenestration assembly 52 or rough opening 20.

Figure 4:
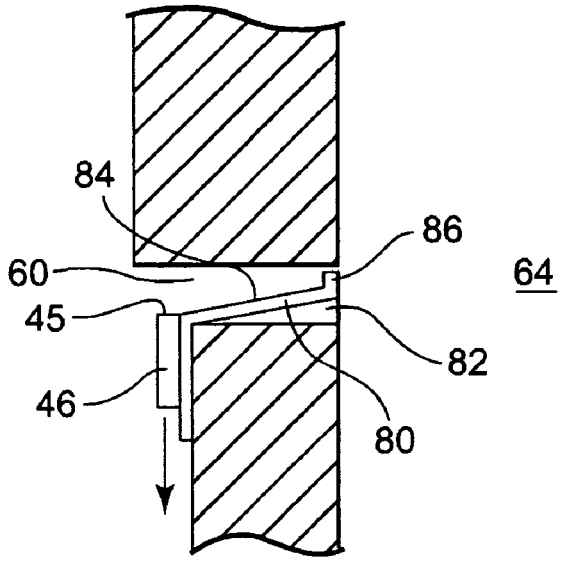
FIG. 4 is a cross sectional view of an alternate drainage system in accordance with the present invention.

FIG. 4 illustrates an alternate moisture barrier 80 in accordance with the present invention. Legs 82 on the moisture barrier 80 adjacent to the interior side 64 retain the collection surface 84 at a slight angle. Any water that accumulates in the gap 60 is biased toward the channel entrance 45 of the channel assembly 46. In the illustrated embodiment, the moisture barrier 80 includes a lip or ridge 86 to prevent water from migrating into the interior side 64. The lip 86 may be used with or without the interior seal 62 of FIG. 2.

Figure 5A:
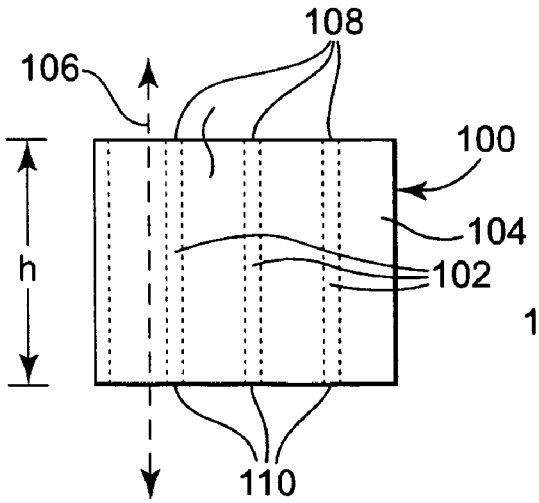
FIGS. 5A and 5B are front and top views of a channel assembly in accordance with the present invention.
Figure 5B:
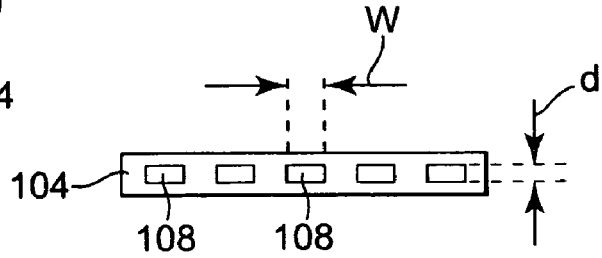

FIGS. 5A and 5B illustrate one embodiment of a channel assembly 100 in accordance with the present invention. A series of channels 102 are formed in a block of material 104. Each channel 102 includes a channel entrance 108 and a discharge opening 110. The channels 102 are generally parallel to axis 106. The material is preferably a moisture impermeable substance, such as metal, plastic, ceramic, or the like. The channels 102 can be formed by molding, machining, or a variety of other known methods.

In order to generate the optimum siphoning action of the present drainage system, the channels 102 preferably have an effective cross-sectional area within a specific range. If the effective cross-sectional area is too small, the surface tension of the water will likewise prevent proper operation of the present drainage system 32. If the effective cross-sectional area is too large, insufficient liquid is typically available to establish a siphon. In the preferred embodiment, the effective cross-sectional area of the channels 102 does not vary along the height h of the channel assembly 100, although variation is possible for some embodiments.

The major and minor dimensions of the cross-sectional area are also preferably within a specific range. In the embodiment of FIGS. 5A and 5B, the channels 102 have a major dimension or width w and a minor dimension or depth d. The maximum dimension in any one direction is the width w. It is the combination of effective cross-sectional area, major dimension and minor dimension that optimizes the operation of the present channel assembly 100.

In the preferred embodiment, the channels 102 have an effective cross-sectional area of less than about 0.625 inches$^2$ and more preferably less than about 0.1 inch$^2$, and most preferably less than about 0.05 inches$^2$. An effective cross-sectional area of about 0.012 inches$^2$, which corresponds to the effective cross-sectional area of a ⅛ inch inner diameter (ID) tube, is a preferred effective cross-sectional area. An effective cross-sectional area of about 0.0012 inches$^2$, which corresponds to a 0.040 inch inner diameter (ID) tube, is the minimum effective cross-sectional area. As used herein, the "effective cross-sectional area" refers to the cross sectional area of a channel measured perpendicular to an axis of the channel. Alternatively, the effective cross-sectional area can be viewed as the minimum cross-sectional area generally perpendicular to the flow of water through the channel.

For channels 102 with a non-circular cross-sectional area, the maximum dimension along a major dimension is preferably less than about 6 inches, and more preferably less than about 4 inches and most preferably less than about 2 inches. The dimension along the minor dimension is preferably between about 0.04 inches and about 0.4 inches, and more preferably between about 0.04 inches and about 0.2 inches, and most preferably between about 0.04 inches and about 0.1 inches. The major and minor dimensions are selected so that the effective cross-sectional area is within the range of about 0.0012 inches$^2$ to about 0.625 inches$^2$. In the illustrated embodiments, the major dimension is typically parallel to the vertical surface 44 and the minor dimension is perpendicular to the vertical surface 44.

For channels 102 with a generally circular cross-sectional area, major dimension and the minor dimension are both the diameter of the channel 102. The diameter of a generally circular channel 102 is preferably between about 0.04 inches and about 0.4 inches, and more preferably between about 0.04 inches and about 0.2 inches, and most preferably between about 0.04 inches and about 0.1 inches. A tube with an ID of about 0.4 inches has a cross-sectional area of about 0.126 inches$^2$, which is within the range of 0.0012 inches$^2$ to about 0.625 inches$^2$. A tube with an ID of about 0.04 inches has a cross-sectional area of about 0.0012 inches$^2$, which is within the range of 0.0012 inches$^2$ to about 0.625 inches$^2$.

For example, in an embodiment where the minor dimension is about 0.4 inches, the major dimension needs to be less than about 1.56 inches in order to be within the acceptable range of effective cross-sectional areas. Similarly, in an embodiment where the minor dimension is about 0.2 inches, the major dimension needs to be less than about 3.125 inches in order to be within the acceptable range of effective cross-sectional areas.

In an example where the minor dimension is about 0.04 inches, however, the major dimension could be as large as 15.625 inches and still be within the acceptable range of effective cross-sectional areas. This major dimension, however, violates the rule that the major dimension be less than about 6 inches. Consequently, the major dimension would be limited to about 6 inches where the minor dimension is about 0.04 inches.

The channel assembly 100 has a height h that is preferably greater than about 0.5 inches up to about 12 inches. The height h may vary depending upon the effective cross-sectional area of the channels 102.

For example, if the effective cross-sectional area of a channel 102 exceeds the maximum effective cross-sectional area the siphoning action will not be established or the draw will be insufficient to operate the present drainage system 32 as intended. Even if the maximum effective cross-sectional area is not exceeded, the maximum minor dimension can not be exceeded; otherwise the drainage system will not function as intended.

Figure 6A:
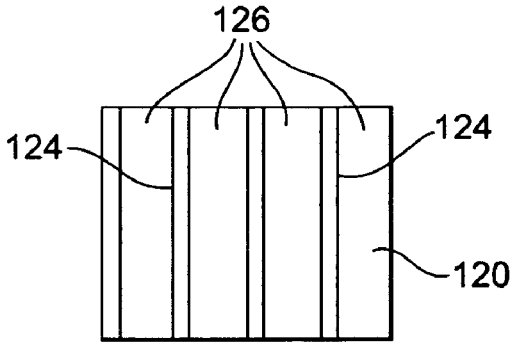
FIGS. 6A and 6B are front and top views of an alternate channel assembly in accordance with the present invention.
Figure 6B:
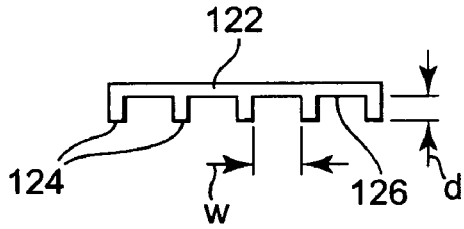

FIGS. 6A-6B illustrate an alternate channel assembly 120 in accordance with the present invention. A carrier 122 includes a plurality of ribs 124 forming a plurality of open channels 126. In the embodiment of FIG. 6B, the channels 126 has a major dimension or width w and a minor dimension or depth d. The carrier 122 can be a flexible sheet or a rigid or semi-rigid member.

Figure 6C:
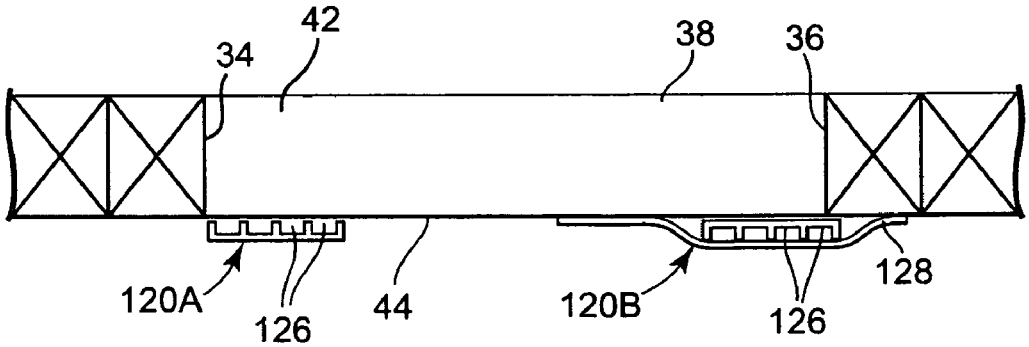
FIG. 6C is a top view of a rough opening with the channel assembly of FIG. 6A.

As best illustrated in FIG. 6C, the channel assembly 120 (see channel assembly 120A) can optionally be installed below the collection surface 42 with the open channels 126 facing toward the generally vertical surface 44 of the moisture barrier 38. The generally vertical surface 44 closes the channels 126. The channel assembly 120A can be attached to the generally vertical surface 44 using a variety of conventional techniques, such as, for example, adhesives, fasteners, and the like.

Alternatively, the channel assembly 120 (see channel assembly 120B) can optionally be installed below the collection surface 42 with the open channels 126 facing away from the generally vertical surface 44 of the moisture barrier 38. A strip of flashing tape 128 is positioned across the open channels 126. In one embodiment, the flashing tape 128 also serves to attach the channel assembly 120B to the generally vertical surface 44. In the illustrated embodiment, the channel assemblies 120A, 120B are located near the bottom corners 34, 36, respectively.

Figure 7A:
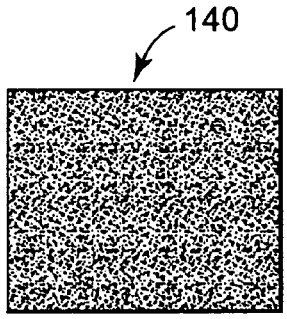
FIGS. 7A and 7B are front and top views of an alternate channel assembly in accordance with the present invention.
Figure 7B:
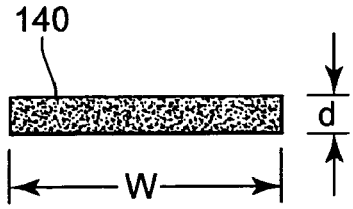

FIGS. 7A-7B illustrate an alternate channel assembly 140 in accordance with the present invention. The channel assembly 140 can be constructed from a woven or non-woven web constructed from metal or various synthetic materials. In one embodiment, the channel assembly 140 is constructed from an open cell foam. The construction of the channel assembly 140 is such that it effectively operates as a single channel. In particular, the interstitial spaces within the channel assembly 140 are typically fluidly coupled. Consequently, the major dimension or width w and the minor dimension or depth d preferably meet the size requirements for a channel discussed above.

Figure 7C:
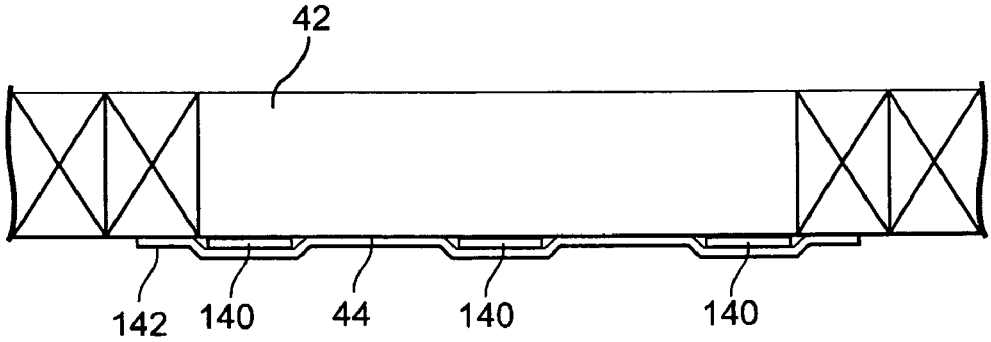
FIG. 7C is a top view of a rough opening with the channel assembly of FIG. 7A.

As best illustrated in FIG. 7C, the channel assembly 140 is installed below the collection surface 42 and attached to the generally vertical surface 44 using a variety of conventional techniques, such as, for example, adhesives, fasteners, and the like. In the illustrated embodiment, flashing tape 142 is applied to each discrete channel assembly 140. The flashing tape 142 is water impermeable and serves to isolate each discrete channel assembly 140 so that the size requirements for a channel are satisfied.

Figure 8:
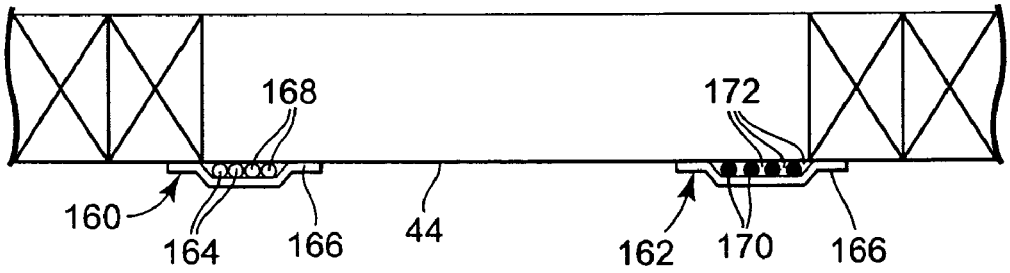
FIG. 8 is a top view of a rough opening with alternate channel assemblies in accordance with the present invention.

FIG. 8 illustrates alternate channel assemblies 160, 162 in accordance with the present invention. Channel assembly 160 is formed of a plurality of tubes 164 attached to the generally vertical surface 44 with flashing tape 166. Each tube 164 operates as a discrete channel 168 in the channel assembly 160.

Channel assembly 162 is formed of a plurality of fibers or filaments 170 attached to the generally vertical surface 44 with flashing tape 166. The filaments 170 operate as ribs or spacers, and the gaps between adjacent ribs 170 operate as discrete channels 172.

Figure 9:
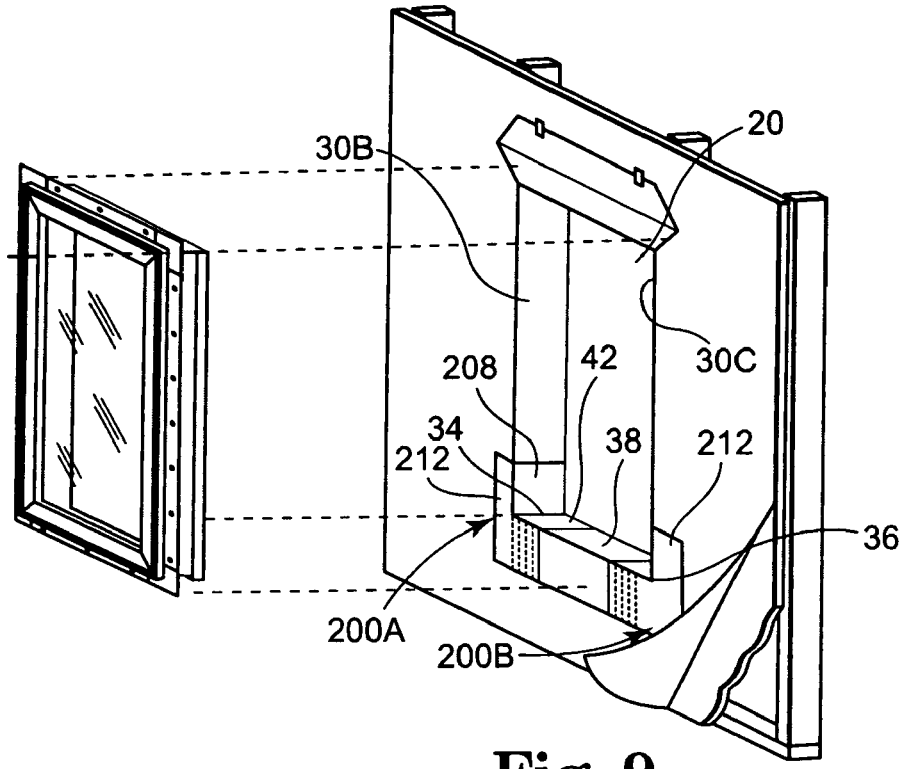
FIG. 9 is an exploded perspective view of a structure and a fenestration assembly with an alternate drainage system in accordance with the present invention.

FIG. 9 illustrates molded channel assemblies 200A, 200B (referred to collectively as "200") in accordance with the present invention. The channel assemblies 200A, 200B are mirror images of each other so as to fit in the opposing bottom corners 34, 36. Further disclosure will be directed to a single channel assembly 200. The moisture barrier 38 is preferably positioned on the collection surface 42. The molded channel assemblies 200 are positioned over the moisture barrier 38 in each bottom corner 34, 36 of the rough opening 20.

Figure 10:
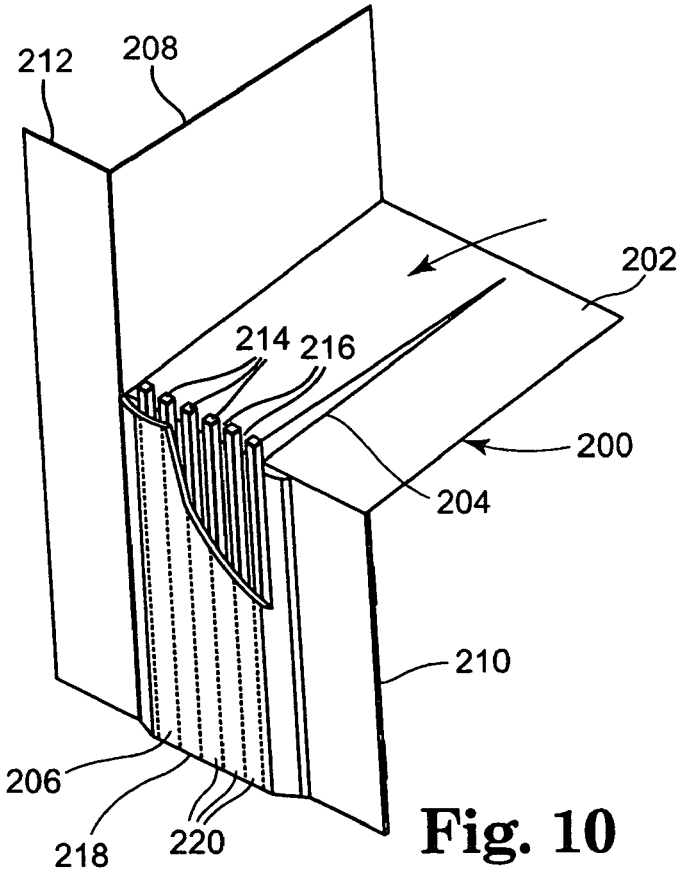
FIG. 10 is perspective view of a portion of the drainage system of FIG. 9.

As best illustrated in FIG. 10, the molded channel assembly 200 include horizontal member 202 that serves as part of the collection surface portion 42. Rib 204 is optionally located on the horizontal member 202 to direct the water to the channel assembly 206. Member 208 is attached to the horizontal members 202 and extends up along the inner surfaces 30B, 30C of the rough opening 20 (see FIG. 9). The channel assembly 206 is located on vertical portion 210. The vertical portion 210 preferably includes an extension 212 that extend beyond the bottom corners 34, 36 onto the exterior surface 40.

The channel assemblies 206 include a plurality of ribs 214 that form a plurality of discrete channels 216. Water entering the channels 216 is discharged from discharge openings 220. Cover 218 can optionally be molded as part of the channel assembly 200. Alternatively, a flashing tape can be applied to complete the channels 216, and optionally secure the channel assembly 200 to the rough opening 20.

The channel assembly 200 is preferably molded as a unitary structure from a polymeric material. Alternatively, the channel assembly 200 can be constructed from multiple pieces. In one embodiment, the multiple pieces are connected using adhesives, interlocking fasteners or a combination thereof.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A drainage system for a fenestration assembly located in a rough opening of a structure, the drainage system comprising:

a moisture barrier located between at least a bottom of the fenestration assembly and a bottom inner surface of the rough opening, the moisture barrier comprising a horizontal portion extending generally horizontally along the bottom inner surface of the rough opening and a vertical portion extending generally vertically downward below the rough opening on an external side of the structure; and a channel assembly located generally below the rough opening, the channel assembly comprising:

at least one channel having a channel entrance proximate the bottom inner surface of the rough opening and a discharge opening directed toward a drainage area, the channel comprising an effective cross-sectional area selected to siphon water located on the moisture barrier to the drainage area such that water draining through the channel generates sufficient vacuum pressure to pull moisture across the horizontal portion of the moisture barrier towards the channel entrance.

2. The drainage system of claim 1 wherein the moisture barrier is located on a sill plate of the structure.

3. The drainage system of claim 1 wherein the moisture barrier extends up a portion of a side inner surface of the rough opening.

4. The drainage system of claim 1 wherein the moisture barrier comprises one of a flexible sheet or a rigid material.

5. The drainage system of claim 1 wherein a portion of the moisture barrier comprises a molded structure.

6. The drainage system of claim 1 further comprising an interior seal located between the moisture barrier and the bottom of the fenestration assembly proximate an interior side of the structure.

7. The drainage system of claim 1 wherein the channel assembly comprises a block of material with a plurality of channels.

8. The drainage system of claim 1 wherein the channel assembly comprises a plurality of ribs forming a plurality of discrete channels.

9. The drainage system of claim 1 wherein the channel assembly comprises:

a carrier having a plurality of ribs forming a plurality of open channels; and flashing tape extending across the ribs forming a plurality of closed channels.

10. The drainage system of claim 1 wherein the channel assembly comprises:

a woven or non-woven web of material; and a flashing tape sealing a front and at least a portion of side edges of the woven or non-woven web of material to the vertical portion of the moisture barrier.

11. The drainage system of claim 1 wherein the channel assembly comprises:

a plurality of tubes located on the vertical portion of the moisture barrier; and a flashing tape sealing a front and at least a portion of side edges of the tubes to the vertical portion of the moisture barrier.

12. The drainage system of claim 1 wherein the channel assembly comprises an integrally molded structure comprising a collection surface, a vertical portion, and the channel is located on the vertical portion.

13. The drainage system of claim 1 wherein the channel assembly comprises:

an integrally molded structure comprising a collection surface, a vertical portion, and a plurality of open channels located on the vertical portion; and flashing tape extending across the open channels to form closed channels.

14. The drainage system of claim 1 wherein the channel assembly is attached to the vertical portion of the moisture barrier.

15. The drainage system of claim 1 wherein the channels are located proximate bottom corners of the rough opening.

16. The drainage system of claim 1 wherein the channels are located less than 4 inches from bottom corners of the rough opening.

17. The drainage system of claim 1 wherein the channels are located less than 2 inches from bottom corners of the rough opening.

18. The drainage system of claim 1 wherein the channel comprises an effective cross-sectional area in a range of about 0.0012 $inch^2$ to about 0.625 $inch^2$.

19. The drainage system of claim 1 wherein the channel comprises an effective cross-sectional area in a range of about 0.0012 $inch^2$ to about 0.1 $inch^2$.

20. The drainage system of claim 1 wherein the channel comprises an effective cross-sectional area in a range of about 0.0012 $inch^2$ to about 0.05 $inch^2$.

21. The drainage system of claim 1 wherein the channel comprises a generally circular cross-sectional area with a diameter of about 0.040 inches to about 0.4 inches.

22. The drainage system of claim 1 wherein the channel comprises a generally circular cross-sectional area with a diameter of about 0.040 inches to about 0.2 inches.

23. The drainage system of claim 1 wherein the channel comprises a generally circular cross-sectional area with a diameter of about 0.040 inches to about 0.1 inches.

24. The drainage system of claim 1 wherein the channel comprises a non-circular cross-sectional area with a major dimension of about 0.04 inches to about 6 inches and a minor dimension of about 0.040 inches to about 0.4 inches, provided the channel has an effective cross-sectional area in a range of about 0.0012 $inch^2$ to about 0.625 $inch^2$.

25. The drainage system of claim 1 wherein the channel comprises a height of at least about 0.5 inches.

26. The drainage system of claim 1 wherein the moisture barrier comprises a collection surface that is fluidly coupled to the channel entrance.

27. A method of installing a drainage system with a fenestration assembly located in a rough opening of a structure, the method comprising the steps of:

locating a moisture barrier between at least a bottom of the fenestration assembly and a bottom inner surface of the rough opening;

extending a first portion of the moisture barrier over the bottom inner surface of the rough opening and a second portion of the moisture barrier generally vertically downward below the rough opening on an external side of the structure to form a vertical portion;

locating a channel assembly generally below the rough opening so that a channel entrance is proximate the bottom inner surface of the rough opening and a discharge opening is directed toward a drainage area; and selecting a channel with an effective cross-sectional area adapted to siphon water located on the moisture barrier to the drainage area such that water draining through the channel generates sufficient vacuum pressure to pull moisture from across the first portion of the moisture barrier towards the channel entrance.

28. The method of claim 27 further comprising locating the first portion of the moisture barrier on a sill plate of the structure.

29. The method of claim 27 further comprising angling a moisture collection surface of the moisture barrier to direct moisture to the channel entrance.

30. The method of claim 27 further comprising locating an interior seal between the moisture barrier and the bottom of the fenestration assembly proximate an interior side of the structure.

31. The method of claim 27 further comprising attaching the channel assembly to the vertical portion of the moisture barrier.

32. The method of claim 27 further comprising locating the channels proximate bottom corners of the rough opening.

33. The method of claim 27 further comprising locating the channels less than 4 inches from bottom corners of the rough opening.

34. The method of claim 27 further comprising locating the channels less than 2 inches from bottom corners of the rough opening.

35. The method of claim 27 comprising selecting a channel with an effective cross-sectional area in a range of about 0.0012 $inch^2$ to about 0.625 $inch^2$.

36. The method of claim 27 comprising selecting a channel with an effective cross-sectional area in a range of about 0.0012 $inch^2$ to about 0.1 $inch^2$.

37. The method of claim 27 comprising selecting a channel with an effective cross-sectional area in a range of about 0.0012 $inch^2$ to about 0.05 $inch^2$.

38. The method of claim 27 comprising selecting a channel with a generally circular cross-sectional area and a diameter of about 0.040 inches to about 0.4 inches.

39. The method of claim 27 comprising selecting a channel with a non-circular cross-sectional area having a major dimension of about 0.04 inches to about 6 inches and a minor dimension of about 0.040 inches to about 0.4 inches, provided the channel has an effective cross-sectional area in a range of about 0.0012 $inch^2$ to about 0.625 $inch^2$.

* * * * *